US010329077B2

(12) United States Patent
Kieffer et al.

(10) Patent No.: US 10,329,077 B2
(45) Date of Patent: Jun. 25, 2019

(54) CLOSURE ASSEMBLY AND METHOD FOR OPENING

(71) Applicant: Currier Plastics, Inc., Auburn, NY (US)

(72) Inventors: Gary John Kieffer, Moravia, NY (US); Steven Michael Faes, Canisteo, NY (US)

(73) Assignee: Currier Plastics, Inc., Auburn, NY (US)

( * ) Notice: Subject to any disclaimer, the term of this patent is extended or adjusted under 35 U.S.C. 154(b) by 7 days.

(21) Appl. No.: 15/281,878

(22) Filed: Sep. 30, 2016

(65) Prior Publication Data

US 2017/0096265 A1 Apr. 6, 2017

Related U.S. Application Data

(60) Provisional application No. 62/235,634, filed on Oct. 1, 2015.

(51) Int. Cl.

| | |
|---|---|
| ***B65D 47/08*** | (2006.01) |
| ***B65D 43/16*** | (2006.01) |
| ***B65D 83/08*** | (2006.01) |
| *B65D 75/58* | (2006.01) |

(52) U.S. Cl.

CPC ..... *B65D 83/0805* (2013.01); *B65D 43/161* (2013.01); *B65D 43/162* (2013.01); *B65D 43/163* (2013.01); *B65D 43/169* (2013.01); *B65D 47/0828* (2013.01); *B65D 75/5877* (2013.01)

(58) Field of Classification Search

CPC ..... B65D 47/0828; B65D 43/169; B65D 43/161; B65D 43/162; B65D 43/163; B65D 83/0805

USPC ..... 220/254.5

See application file for complete search history.

(56) References Cited

U.S. PATENT DOCUMENTS

| | | | | |
|---|---|---|---|---|
| 4,711,360 | A * | 12/1987 | Ullman | B65D 47/0828 215/235 |
| 5,868,265 | A | 2/1999 | Kobayashi | |
| 7,000,792 | B2 | 2/2006 | Arai | |
| 7,621,420 | B2 | 11/2009 | Bandoh et al. | |
| 8,499,958 | B2 | 8/2013 | Wang | |
| 2002/0017522 | A1* | 2/2002 | Bando | B65D 43/16 220/254.3 |
| 2005/0218105 | A1* | 10/2005 | Arai | B65D 43/22 215/237 |

(Continued)

*Primary Examiner* — Fenn C Matthew
*Assistant Examiner* — Jennifer Castriotta
(74) *Attorney, Agent, or Firm* — Timothy W. Menasco, Esq.; Harter Secrest & Emery LLP

(57) ABSTRACT

Presented is a closure assembly and a method for opening. The closure assembly includes a body, the body defining an opening and a body locking portion, and a lid, the lid moveably affixed to the body and comprising a lid locking portion, the lid locking portion configured to engage the body locking portion to releasably lock the lid in the closed position. The closure assembly also includes a hinge, the hinge being affixed to the lid and the body, the hinge configured to move the lid from a closed position occluding the opening of the body to an open position permitting passage through the opening, the hinge further configured to urge the lid into the open position, and at least one spring member.

18 Claims, 8 Drawing Sheets

(56) References Cited

U.S. PATENT DOCUMENTS

| | | | | |
|---|---|---|---|---|
| 2006/0201904 | A1* | 9/2006 | Comeau | B65D 35/08 215/237 |
| 2007/0138123 | A1* | 6/2007 | Blomdahl | B65D 47/0809 215/235 |
| 2008/0128451 | A1* | 6/2008 | Krauth | B65D 43/169 221/63 |
| 2008/0179326 | A1* | 7/2008 | Krauth | B65D 75/5838 220/260 |
| 2011/0155738 | A1 | 6/2011 | Miyake et al. | |
| 2011/0309099 | A1* | 12/2011 | Bandoh | B65D 43/166 220/849 |
| 2012/0325691 | A1 | 12/2012 | Wang | |
| 2013/0014374 | A1 | 1/2013 | Damaghi et al. | |
| 2013/0019435 | A1 | 1/2013 | Damaghi et al. | |
| 2014/0346172 | A1* | 11/2014 | Banerjee | B65D 43/22 220/257.1 |

* cited by examiner

CLOSURE ASSEMBLY AND METHOD FOR OPENING

FIELD OF THE INVENTION

The present disclosure generally relates to a closure assembly with a lid arranged such that the lid is able to occlude an opening on the closure assembly, and more particularly to a closure assembly with a lid that opens more easily.

BACKGROUND OF THE INVENTION

Containers with closable lids are well known in the art and have been used for numerous purposes. Some containers are designed for maintaining disposable items while other containers are meant to be reused multiple times to hold many different types of items. The containers can come in various shapes and sizes, and are able to hold items including baby wipes, cleaning towels, and the like. For these types of items, dispensing versions of the containers are quite popular due to their ease of use. They allow a user to quickly obtain a single wipe or towel when needed. For instance, a user may require a single or multiple baby wipes while changing a baby's diaper.

In most instances, containers have a very simplistic design in order to allow users to quickly obtain the items dispensed. However there is a need for a container that allows for easier access to its contents.

BRIEF SUMMARY OF THE INVENTION

In view of the foregoing, it is an object of the present disclosure to provide a method and closure assembly for an opening.

A first exemplary embodiment of the present disclosure provides a closure assembly for opening. The closure assembly includes a body, the body defining an opening and a body locking portion, and a lid, the lid moveably affixed to the body and comprising a lid locking portion, the lid locking portion configured to engage the body locking portion to releasably lock the lid in the closed position. The closure assembly further includes a hinge, the hinge being affixed to the lid and the body, the hinge configured to be able to move the lid from a closed position occluding the opening of the body to an open position permitting passage through the opening, the hinge further configured to urge the lid into the open position. The closure assembly still further includes at least one spring member, the at least one spring member located such that the at least one spring member is in a compressed state between the lid and the body when the lid is in the closed position and is in less compressed state when the lid is in the open position, the compressed state of the at least one spring member urging the lid into the open position.

A second exemplary embodiment of the present disclosure provides a method of opening. The method includes providing a closure assembly, the closure assembly having a body, the body defining an opening and a body locking portion, and a lid, the lid moveably affixed to the body and comprising a lid locking portion, the lid locking portion configured to engage the body locking portion to releasably lock the lid in the closed position. The closure assembly also has a hinge, the hinge being affixed to the lid and the body, the hinge configured to be able to move the lid from a closed position occluding the opening of the body to an open position permitting passage through the opening, the hinge further configured to urge the lid into the open position, and at least one spring member, the at least one spring member located such that the at least one spring member is in a compressed state between the lid and the body when the lid is in the closed position and is in less compressed state when the lid is in the open position, the compressed state of the at least one spring member urging the lid into the open position. The method further includes opening the lid of the closure assembly, wherein the lid is urged to the open position by the hinge and the at least one spring member.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Many different types of containers include many different types of lids for opening and closing the container. Many of these lids require the use of one or both of the user's hands to open the lid. Often times a lid also requires that the user physically move the lid to the complete open position and to also hold the lid in the open position. Accordingly, there is a need for a lid that aids in the opening process and also remains in the open position without the user assisting in this process.

Exemplary embodiments of the present disclosure provide a lid for a closure assembly that aids the user in the opening process by urging the lid to the open position and then to the completely open position. Exemplary embodiments further include a lid that remains in the open position without the user physically maintaining the lid in the open position.

Figure 1:
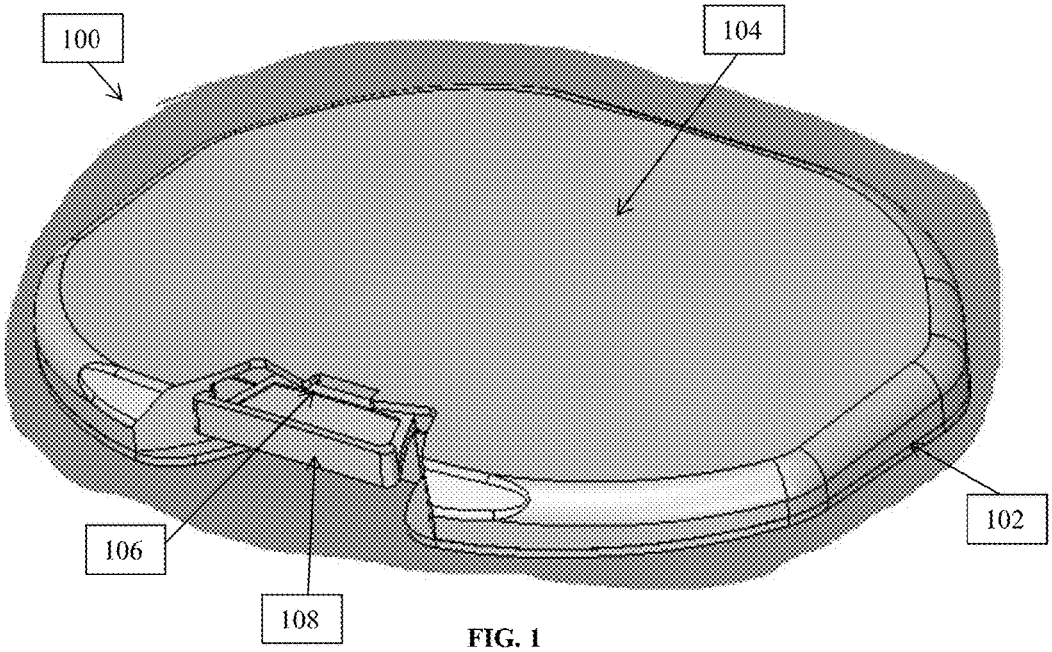
FIG. 1 is a top perspective view of a configuration of a closure assembly in a closed position suitable for use in practicing exemplary embodiments of this disclosure.

Referring to FIG. 1, provided is a top perspective view of a closure assembly 100 in a closed position suitable for use in practicing exemplary embodiments of this disclosure. Shown in FIG. 1 is closure assembly 100, which includes a frame 102, a lid 104, a lock 106 and a push button 108. It should be appreciated that FIG. 1-FIG. 8 depict closure assembly 100, which can be integral with a container 101 (shown in FIG. 9) or can be a separate element that engages, is affixed to, or is attached to container 101. FIG. 9 depicts the body of the container 101 to which closure assembly 100 is affixed. As shown in FIG. 9, closure assembly 100 is affixed to container 101 at the top surface 101A such that closure assembly 100 is operable to occlude opening 103 on container 101 in the closed position. Embodiments of opening 103 provide a passage to an interior of container 101 or to a product maintained within the interior of container 101. Exemplary embodiments of the container 101 can include any type of size and configuration known in the art including flexible plastic disposable containers.

Exemplary embodiments of frame 102 are typically sized to define an opening which is coextensive with an opening 103 of an exemplary container 101. Exemplary embodiments of frame 102 include a solid outside ring which defines the opening. Exemplary embodiments of frame 102 are rigid and flexible to allow minor bending of frame 102 when placed under pressure. Exemplary embodiments of frame 102 can be made out of any type of plastic, resin, or a composite material. Exemplary embodiments of lid 104 are moveably affixed to frame 102 such that it can move from a closed position, as shown in FIG. 1 occluding the opening in the frame 102, to an open position leaving the frame 102 uncovered. Lid 104 is sized such that it completely occludes the opening of frame 102 when it is in the closed position as shown in FIG. 1.

Exemplary embodiments of lid 104 are releasably maintained in the closed position by lock 106. Exemplary embodiments of lock 106 provide a mechanism that allows lid 104 to remain in the closed position when a portion of lid 104 interacts with lock 106 and also provides a means for lid 104 to be released from lock 106 so that lid 104 can be moved to the open position. Push button 108, as shown in FIG. 1, provides a means to selectively release lid 104 from lock 106 to allow lid 104 to move to the open position. Exemplary embodiments of push button 108 provide that lock 106 is moved from the locked to the unlocked position when push button 108 is compressed by a user or other object. Exemplary embodiments of push button 108 provide that its normal static position is in the uncompressed state such that it is able to maintain lid 104 in the locked closed position. It should be appreciated that exemplary embodiments of push button 108 include any type of lock release mechanism including levers, lifting mechanisms, twisting mechanisms and the like.

Figure 2:
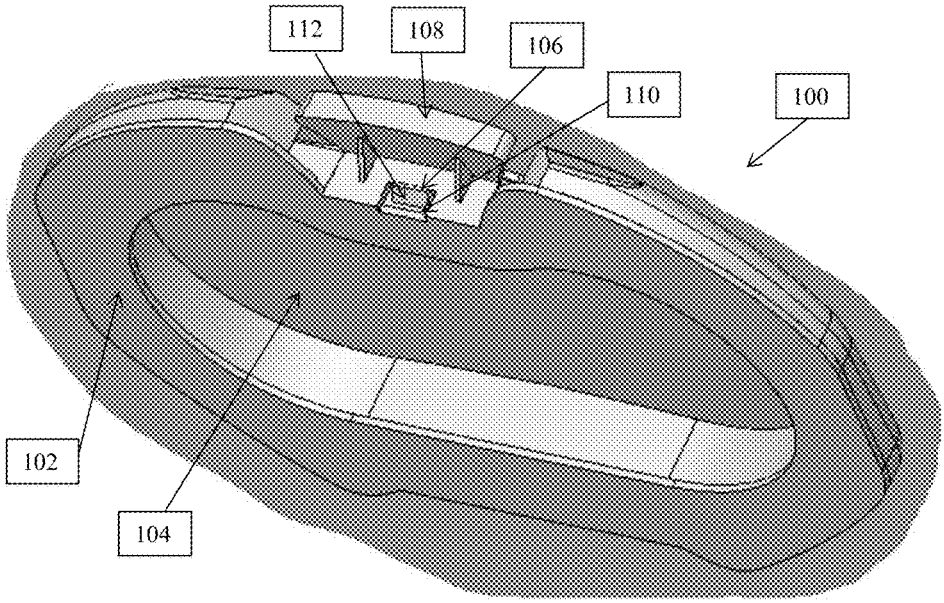
FIG. 2 is a bottom perspective view of a configuration of a closure assembly in a closed position suitable for use in practicing exemplary embodiments of this disclosure.

Referring to FIG. 2, shown is a bottom perspective view of a configuration of closure assembly 100 in a closed position. Shown in FIG. 2 is the underside of frame 102, the underside of lid 104, lock 106, and the underside of push button 108. As can be seen, frame 102 defines the opening that is occluded by lid 104 in the closed position. Lock 106, as depicted, includes a slot 110 and catch 112. Exemplary embodiments of slot 110 provide a space or opening in frame 102 that can interact with catch 112. Exemplary embodiments of catch 112 are fixedly attached to lid 104 and are sized to fit within slot 110. Exemplary embodiments of catch 112 include a flat top surface that engages a top portion of slot 110 preventing catch 112 from being released from slot 110, which would allow lid 104 to move from the closed position to the open position.

Exemplary embodiments of closure assembly 100 include a push button 108 that when compressed by a user or an object substantially moves catch 112 such that it no longer engages slot 110. For example, as shown in FIG. 2, compression of push button 108 will move catch 112 towards the rear of closure assembly 100 such that catch 112 no longer engages slot 110 and lid 104 may freely move to the open position. In this exemplary embodiment of closure assembly 100, lid 104 with catch 112 will be somewhat flexible such that catch 112 can be moved so that it does not engage slot 110, yet also resilient enough to maintain its position and integrity when catch 112 is located within slot 110 and lid 104 is in the closed locked position.

Figure 3:
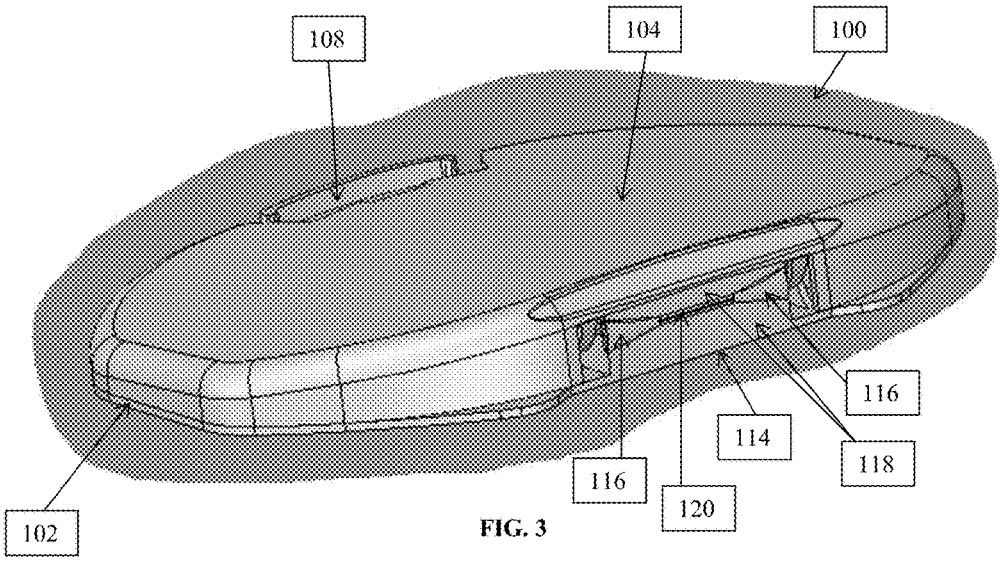
FIG. 3 is a rear perspective view of a configuration of a closure assembly in a closed position suitable for use in practicing exemplary embodiments of this disclosure.

Referring to FIG. 3, shown is a rear perspective view of a configuration of closure assembly 100 in the closed position. Shown in FIG. 3 are frame 102, lid 104, push button 108, and hinge 114. Hinge 114 is coupled to frame 102 and lid 104. Hinge 114 shown in FIG. 3 includes two opposing rigid lateral members 116, two opposing rigid vertical members 118, and a less rigid connector region 120. Exemplary embodiments of less rigid connector region 120 (or living hinges) are able to flex, bow, or stretch such that lid 104 can move between the open and closed position. Hinge 114 as shown in FIG. 3 is located at the rear of device 100. However, it should be appreciated that hinge 114 may be located in any number of locations provided that it allows frame 102 to be coupled to lid 104.

Exemplary embodiments of hinge 114 urge lid 104 to the open position when lid 104 is not in a closed locked position. For example, a butterfly hinge captures potential energy in the form of a compressed or deformed component that biases to its uncompressed state. In another exemplary embodiment, hinge 114 urges lid 104 to the open position more forcefully when lid 104 is located between 60° to 120° relative to frame 102 and less forcefully when lid 104 is located between 0° to 60° relative to frame 102.

Figure 4:
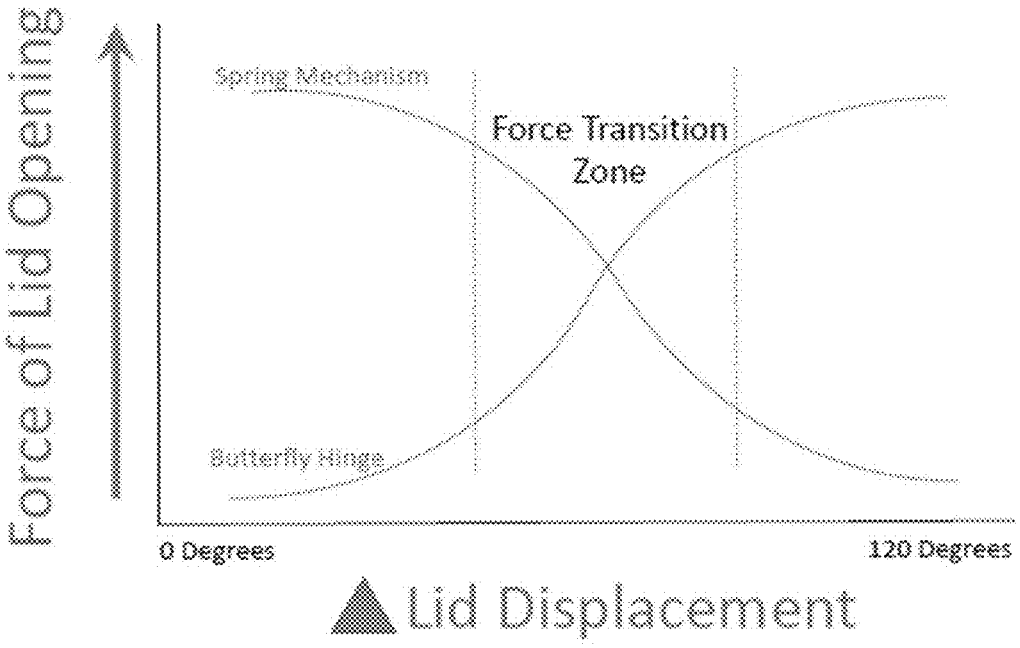
FIG. 4 is an exemplary force diagram of a closure assembly suitable for use in practicing exemplary embodiments of this disclosure.

FIG. 4 depicts a force curve that represents the increase and decrease of force applied by an exemplary hinge 114 as lid 104 moves between the closed position (0° relative to frame 102) to the open position (120° relative to frame 102). In FIG. 4, hinge 114 is represented by the curve titled "Butterfly Hinge". As is evident, the force applied by the Butterfly Hinge curve increases as the displacement of lid 104 moves from 0° to 120° relative to frame 102. It should be appreciated that a Butterfly Hinge is merely an exemplary embodiment of hinge 114. Hinge 114 can include any type of hinge that is able to provide an increase in the force applied to lid 104 as lid 104 moves from 0° to an open position, such as 120° relative to frame 102.

Figure 5:
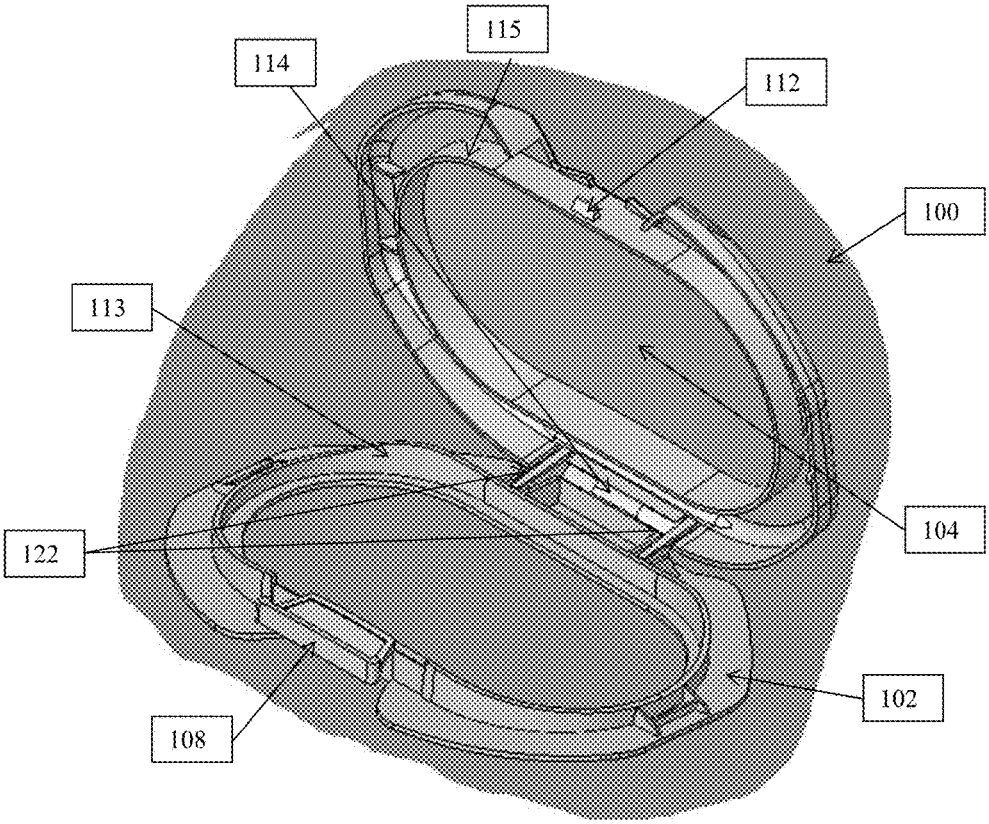
FIG. 5 is a top perspective view of a configuration of a closure assembly in a half open position suitable for use in practicing exemplary embodiments of this disclosure.

Referring to FIG. 5, shown is a top perspective view of an exemplary device 100 in a half open position. Shown in FIG. 5 is device 100 with frame 102, lid 104, push button 108, catch 112, hinge 114, and flexible beams 122. As is evident from FIG. 5, when lid 104 is in the open position, the opening in the frame 102 is revealed as it is no longer occluded by lid 104. As depicted in FIG. 5, flexible beams 122 extend from lid 102 and are located on opposing sides of hinge 114. Flexible beams 122 as shown are substantially perpendicular to the surface of lid 104. However, exemplary embodiments of flexible beams 122 need not be substantially perpendicular to the surface of lid 104 provided that they operate as described below.

Exemplary embodiments of flexible beams 122 are sized such that they engage frame 102 and are placed in a compressed state between frame 102 and lid 104 when lid 104 is in the closed position. Flexible beams 122 operate by urging lid 104 into the open position when push button 108 is compressed and lock 106 is released allowing lid 104 to move freely. Exemplary embodiments of flexible beams 122 are able to flex, bow, or stretch in response to being compressed between lid 104 and frame 102, yet are also able to maintain their shape and structure when allowed to freely move. FIG. 5 depicts flexible beams 122 as being integral with lid 104, however, alternative exemplary embodiments of flexible beams 122 may be affixed to frame 102, integral with frame 102, or affixed to lid 104.

Referring to FIG. 4 again, also shown is a force curve for a spring mechanism versus lid displacement. The spring mechanism in this case refers to exemplary embodiments of flexible beams 122. As is evident, the force applied by exemplary flexible beams 122 between frame 102 and lid 104 is highest when the lid is at the closed position (0° relative to the frame 102) and gradually decreases as the lid is opened and moves to the open position (120° relative to frame 102). Thus, flexible beams 122 urge lid 104 into the open position with a force greatest when lid 104 is in the closed position (0° relative to frame 102) and with the least amount of force with lid 104 is in the open position (120° relative to frame 102).

Also shown in FIG. 5 is frame lip 113 and lid lip 115. Frame lip 113 protrudes upwards toward lid 104 from the inside surface of frame 102. Likewise, lid lip 115 protrudes downwards toward frame 102 from the surface of lid 104. Frame lip 113 and lid lip 115 together create a sealed interface when lid 104 is in the closed position. The interaction between frame lip 113 and lid lip 115 provide a barrier that more securely separates items within the container from the outside world when lid 104 is in the closed position.

Figure 6:
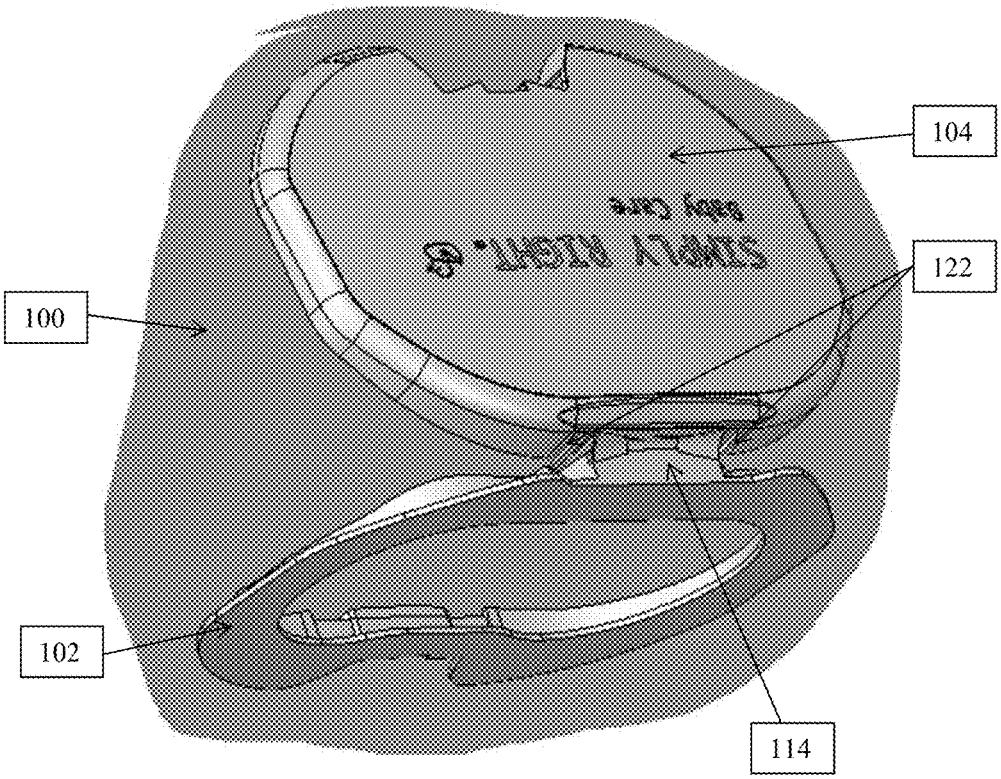
FIG. 6 is a rear perspective view of a configuration of a closure assembly in a half open position suitable for use in practicing exemplary embodiments of this disclosure.

Referring to FIG. 6, shown is a rear perspective view of closure assembly 100 in a half open position. Shown in FIG. 6 is closure assembly 100 with frame 102, lid 104, hinge 114, and flexible beams 122. It will be appreciated that from this perspective it can be seen that flexible beams 122 do not touch or engage frame 102 and thus does not provide a force urging lid 104 into the open position. In FIG. 6, both hinge 114 and flexible beams 122 provide the force urging and moving lid 104 into the open position.

Figure 7:
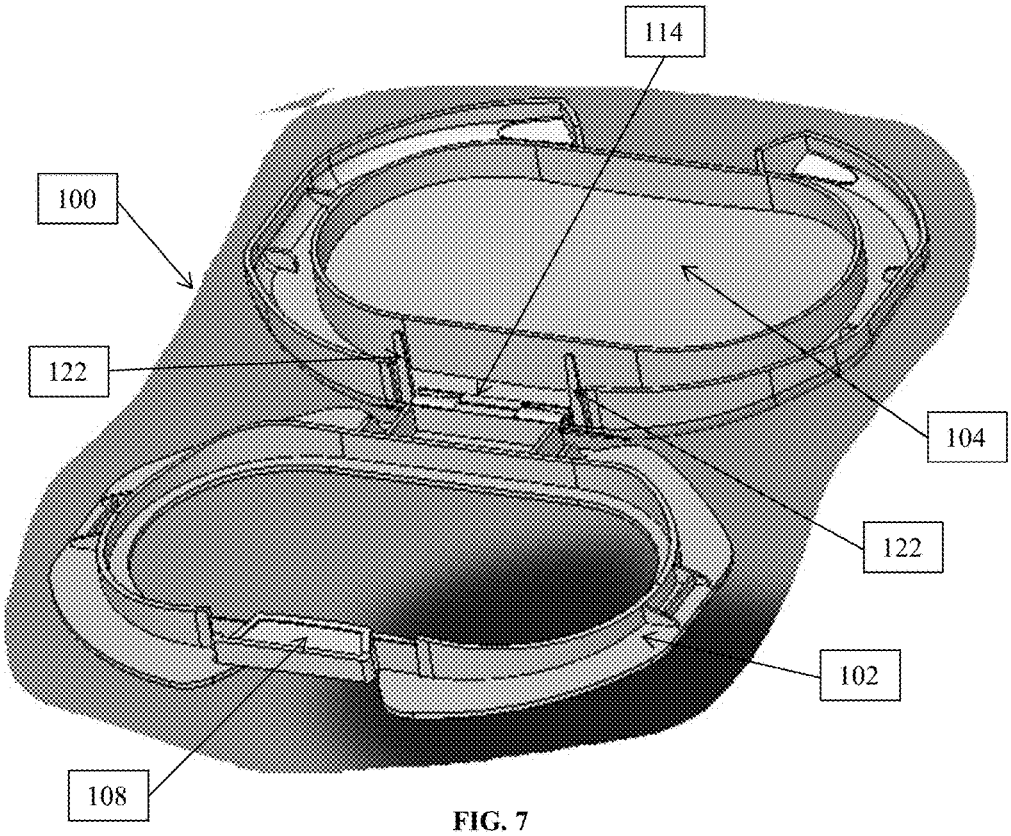
FIG. 7 is a top perspective view of a configuration of a closure assembly in a complete open position suitable for use in practicing exemplary embodiments of this disclosure.

Referring to FIG. 7, shown is a perspective view of closure assembly 100 in a complete open position. Shown in FIG. 7 is closure assembly 100 with frame 102, lid 104, push button 108, hinge 114, and flexible beams 122. In the configuration shown in FIG. 7, lid 104 is located at roughly 180° relative to the surface of frame 102. In this configuration, exemplary embodiments of flexible beams 122 and hinge 114 do not urge lid 104 to a more open position. That is, flexible beams 122 and hinge 114 do not urge lid 104 to move to a position of degree greater than 180° relative to frame 102. However, exemplary embodiments of flexible beams 122 and hinge 114 include embodiments wherein flexible beams 122 and hinge 114 only urge lid 104 to the open position until lid 104 reaches 120° relative to frame 102. Other exemplary embodiments of flexible beams 122 and hinge 114 continue to urge lid 104 to the open position when lid 104 is between 120° to 180° relative to frame 102 or less than 120° such as to between 90° and 120°.

Figure 8:
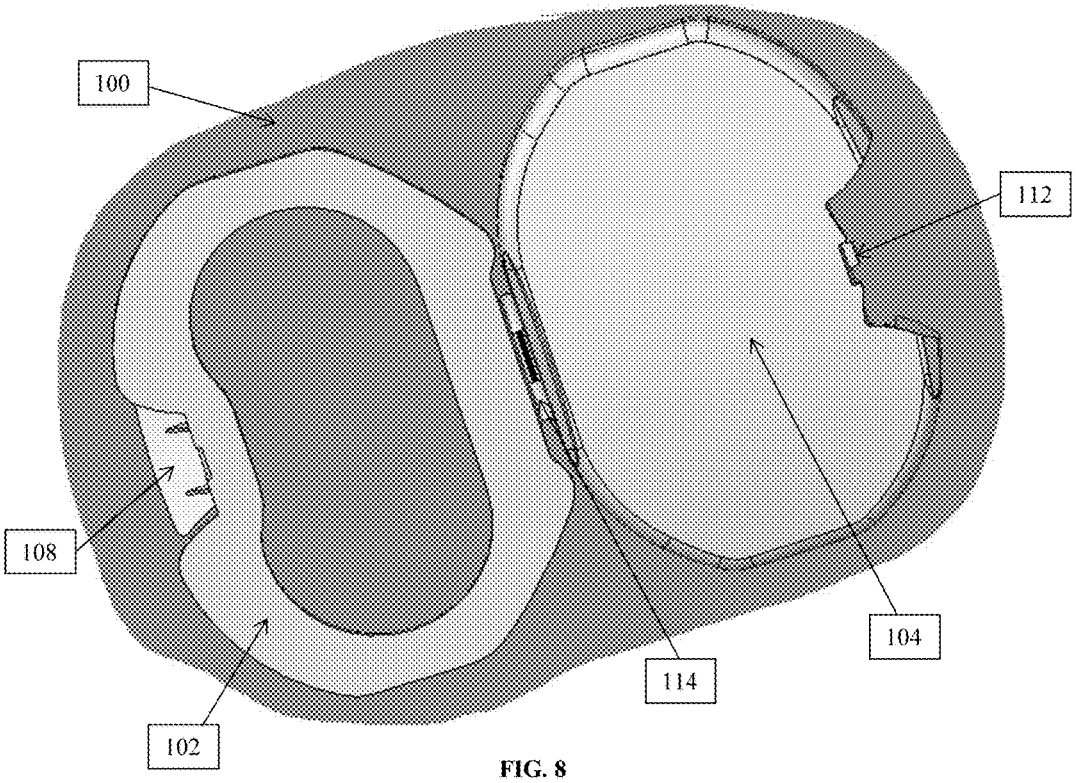
FIG. 8 is a bottom view of a configuration of a closure assembly in a complete open position suitable for use in practicing exemplary embodiments of this disclosure.
Figure 9:
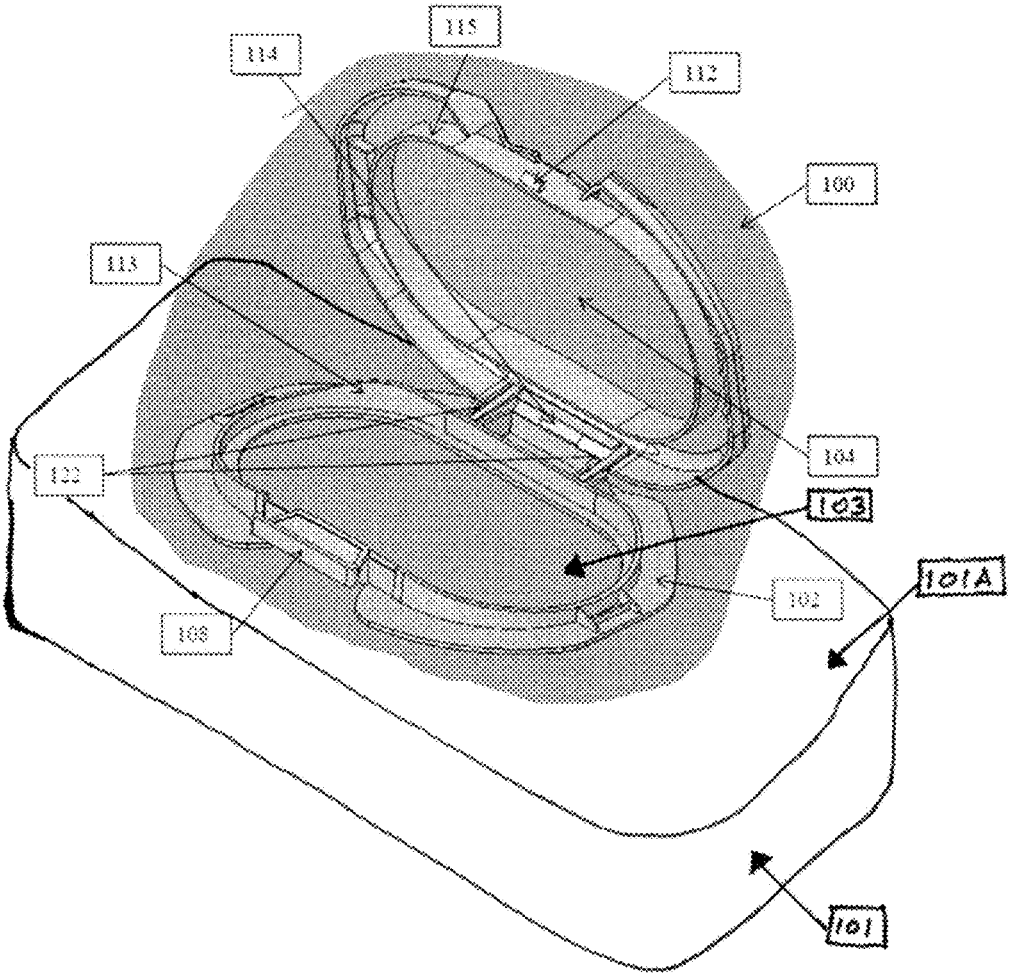
FIG. 9 is a top perspective view of a configuration of a container and closure assembly in a half open position suitable for use in practicing exemplary embodiments of this disclosure.

Referring to FIG. 8, shown is a bottom view of closure assembly 100 in a complete open position. Shown in FIG. 8 is closure assembly 100 with frame 102, lid 104, push button 108, catch 112, and hinge 114.

In practice, when lid 104 is in the closed lock position, a user may compress push button 108 thereby unlocking lid 104. At this point, lid 104 will move toward the open position (e.g., 120° relative to the surface of frame 102) without user assistance. When lid 104 is between 0° to 60°, flexible beams 122 will provide a majority of the force that urges lid 104 into the open position. As shown in FIG. 4, hinge's 114 force will increase as lid 104 moves from 0° to 60° and will provide a majority of the force that urges lid 104 to a more open position (i.e., 120° relative to frame 102). As lid 104 moves beyond 60° relative to frame 102, the force applied by flexible beams 122 decreases as shown in FIG. 4. Thus, exemplary embodiments of the present disclosure provide a closure assembly with a lid that opens without user assistance. A spring member generates a majority of the opening force on the lid when the lid is in a first range of an open position, and a hinge generates a majority of the opening force on the lid when the lid is within a second range of an open position. In other words, in the closed position, the lid is exposed to an opening force when unrestrained by the locking mechanism. The opening force is a combination of forces from a hinge and a bias member, wherein the relative contributions of the hinge and bias member change corresponding to the position of the lid in its range of opening. That is as the lid moves through a first range of opening, the hinge contribution dominates the bias member contribution and through a second range of opening, the bias member contributions dominate the hinge contribution.

Although the opening forces are shown (e.g., in FIG. 4), as operating between 0° and 120° and the magnitude of the forces being substantially equal at 60°, it is understood the operating range of the forces can be between 0° to 60°, 90°, 120°, 150°, or 180° or any other chosen range, with the respective contribution of the opening forces being varied between 0% and 99%, depending on the specific construction of the hinge 114 and the flexible beams 122.

The invention claimed is:

1. A closure assembly comprising:

a body, the body defining an opening and a body locking portion;

a lid, the lid moveably affixed to the body and comprising a lid locking portion, the lid locking portion configured to engage the body locking portion to releasably lock the lid in the closed position;

a hinge, the hinge being affixed to the lid and the body, the hinge configured to move the lid from a closed position occluding the opening of the body to an open position permitting passage through the opening, the hinge further configured to urge the lid into the open position; and at least one spring member, the at least one spring member located such that the at least one spring member is in a compressed state between the lid and the body when the lid is in the closed position and is in a less compressed state when the lid is in the open position, the compressed state of the at least one spring member urging the lid into the open position, wherein the hinge is further configured to substantially urge the lid into the open position when the lid is between 60° to 120° relative to the closed position.

2. The container according to claim 1, wherein the at least one spring member comprises a flexible beam.

3. The container according to claim 2, wherein the at least one spring member is integral with the lid.

4. The container according to claim 3, wherein the hinge comprises a butterfly hinge.

5. The container according to claim 4, wherein the at least one spring member is configured to substantially urge the lid into the open position when the lid is between 0° to 60° relative to the closed position.

6. The container according to claim 4, wherein the lid is predominately urged to the open position by the hinge between 60° to 120° relative to the closed position.

7. The container according to claim 6, wherein the lid is predominately urged to the open position by the at least one spring member between 0° to 60° relative to the closed position.

8. The container according to claim 4, wherein an opening force acting on the lid comprises two components, the two components comprising the hinge and the at least one spring member, the hinge predominately creating the opening force when the lid is between 60° and 120° , relative to the closed position; and the at least one spring member predominately creating the opening force when the lid is between0° and60°relative to the closed position.

9. The container according to claim 2, wherein the at least one spring member is integral with the body.

10. A method of opening, the method comprising:

providing a closure assembly, the closure assembly having a body, the body defining an opening and a body locking portion, a lid, the lid moveably affixed to the body and comprising a lid locking portion, the lid locking portion configured to engage the body locking portion to releasably lock the lid in the closed position, a hinge, the hinge being affixed to the lid and the body, the hinge configured to move the lid from a closed position occluding the opening of the body to an open position permitting passage through the opening, the hinge further configured to urge the lid into the open position, and at least one spring member, the at least one spring member located such that the at least one spring member is in a compressed state between the lid and the body when the lid is in the closed position and is in a less compressed state when the lid is in the open position, the compressed state of the at least one spring member urging the lid into the open position; and opening the lid of the container, wherein the lid is urged to the open position by the hinge and the at least one spring member, wherein the at least one spring member is configured to substantially urge the lid into the open position when the lid is between 0° to 60° relative to the closed position.

11. The method according to claim 10, wherein the at least one spring member comprises a flexible beam.

12. The method according to claim 11, wherein the at least one spring member is integral with the lid.

13. The method according to claim 12, wherein the hinge comprises a butterfly hinge.

14. The method according to claim 13, wherein the hinge is further configured to substantially urge the lid into the open position when the lid is between 60° to 120° relative to the closed position.

15. The method according to claim 13, wherein the lid is predominately urged to the open position by the hinge between 60° to 120° relative to the closed position.

16. The method according to claim 15, wherein the lid is predominately urged to the open position by the at least one spring member between 0° to 60° relative to the closed position.

17. The method according to claim 13, wherein an opening force acting on the lid comprises two components, the two components comprising the hinge and the at least one spring member, the hinge predominately creating the opening force when the lid is between 60° and 120° , relative to the closed position; and the at least one spring member predominately creating the opening force when the lid is between 0° and 60° , relative to the closed position.

18. The method according to claim 11, wherein the at least one spring member is integral with the body.

* * * * *